US008674628B2

(12) United States Patent
Kim et al.

(10) Patent No.: US 8,674,628 B2
(45) Date of Patent: Mar. 18, 2014

(54) LIGHTING SYSTEM AND METHOD FOR CONTROLLING THE SAME

(75) Inventors: Taehoon Kim, Seoul (KR); Junwan Bang, Seoul (KR); Heegu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 67 days.

(21) Appl. No.: 13/340,238

(22) Filed: Dec. 29, 2011

(65) Prior Publication Data

US 2012/0098446 A1 Apr. 26, 2012

(30) Foreign Application Priority Data

Mar. 25, 2011 (KR) ..... 10-2011-0026986

(51) Int. Cl.
*H05B 39/00* (2006.01)

(52) U.S. Cl.
USPC ..... 315/312; 315/318; 315/307

(58) Field of Classification Search
USPC ..... 315/209 R, 210, 224, 225, 86, 119, 127, 315/160, 161, 171–173, 186–193, 291–299, 315/306–311, 362; 340/286.01, 635, 340/815.45
See application file for complete search history.

(56) References Cited

U.S. PATENT DOCUMENTS

| | | | | |
|---|---|---|---|---|
| 5,838,116 | A | 11/1998 | Katyl et al. | |
| 7,598,684 | B2 | 10/2009 | Lys et al. | |
| 8,278,845 | B1 | 10/2012 | Woytowitz | |
| 8,368,325 | B2 | 2/2013 | Kim et al. | |
| 8,410,904 | B2 | 4/2013 | Liu et al. | |
| 2002/0113714 | A1 | 8/2002 | Lopez | |
| 2004/0240890 | A1 | 12/2004 | Lys et al. | |
| 2007/0291483 | A1* | 12/2007 | Lys | 362/227 |
| 2009/0096623 | A1* | 4/2009 | Roosli | 340/635 |
| 2009/0218951 | A1 | 9/2009 | Weaver | |

FOREIGN PATENT DOCUMENTS

| | | | |
|---|---|---|---|
| EP | 2 240 000 | A1 | 10/2010 |
| JP | 2004-063228 | A | 2/2004 |
| JP | 2005-158560 | A | 6/2005 |
| JP | 2010-103023 | A | 5/2010 |
| KR | 10-2004-0104436 | A | 12/2004 |
| KR | 10-2005-0023379 | A | 3/2005 |
| KR | 10-2005-0042281 | A | 5/2005 |
| KR | 10-0551995 | B1 | 2/2006 |
| KR | 10-2007-0046328 | A | 5/2007 |

(Continued)

OTHER PUBLICATIONS

European Search Report dated May 18, 2012 (Appln. No. 11186680.2).

(Continued)

*Primary Examiner* — Alexander H Taningco
*Assistant Examiner* — Christopher Lo
(74) *Attorney, Agent, or Firm* — KED & Associates, LLP

(57) ABSTRACT

A lighting system automatically assigns a unique address to each lighting apparatus, and controls each lighting apparatus based on the assigned address. The lighting system may include a first lighting apparatus, a second lighting apparatus connected to the first lighting apparatus in series, and a bridge device coupled to the first and second lighting apparatuses in series and configured to assign an address to the first and second lighting apparatuses. The bridge device may transmit a first data packet to initialize the lighting apparatuses for address assignment, and a control circuit may disconnect the connections between the lighting apparatuses during address assignment.

18 Claims, 13 Drawing Sheets

(56) References Cited

FOREIGN PATENT DOCUMENTS

| | | | |
|---|---|---|---|
| KR | 10-2007-0053468 | A | 5/2007 |
| KR | 10-0841900 | B1 | 6/2008 |
| KR | 10-0883861 | B1 | 2/2009 |
| KR | 10-0921755 | B1 | 10/2009 |
| KR | 10-0930309 | B1 | 12/2009 |
| KR | 10-0934991 | | 12/2009 |
| KR | 10-2010-0000713 | A | 1/2010 |
| KR | 10-2010-0094692 | A | 8/2010 |
| KR | 10-2010-0125799 | A | 12/2010 |
| KR | 10-2011-0001782 | A | 1/2011 |

OTHER PUBLICATIONS

European Search Report dated May 18, 2012 (Appln. No. 11184995.6).

U.S. Notice of Allowance dated May 10, 2013 (U.S. Appl. No. 13/340,209).

* cited by examiner

FIG. 9

| Start Delimiter | PL (1Byte) | DA (Destination Address (2Bytes)) | SA (Source Address (2Bytes)) | CC (1Byte) | Value (4Btyes) | checkSum (1Byte) | End Delimiter |
|---|---|---|---|---|---|---|---|
| 0x02 | Total Packet Length | If BD, 0x0000<br>Mode 0 : Private Control<br>Mode 1 : Group Control<br>4~12bit : Bit-calculated address | If BD, 0x0000<br>Mode 0 : Private Control<br>Mode 1 : Group Control<br>4~12bit : Bit-calculated address | Command Code | | Sum of start delimiter to end delimiter | 0x03 |

FIG. 10

| CC | Direction | Function | Value | Note |
|---|---|---|---|---|
| 0 × C1 | → | JOIN Start | None | BD transmits 0xC1 to initialize JOIN of RS-485 devices, and restarts JOIN process. |
| 0 × C2 | ← | JOIN Request | Property | registration is requested. DC transmits 0xC2 only when 0xC1 is received. |
| 0 × C3 | → | JOIN Response | Allocated Device-Address | Device is registered and new address or preassigned address response is made. In case of BD or ZG, this message is forwarded to controller, the controller performs address assignment and replies to assigned address. |
| 0 × C4 | ← | JOIN OK | DEVICE ID | 0x04 means that RS-485 device has received JOIN/RESPONSE messages and then JOIN OK message is transmitted so that the corresponding light emitting part is connected to a subsequent part. |
| 0 × C5 | → | JOIN RESET | None | 0xC5 is a broadcast message, severs connection to subsequent part, and restarts the JOIN process (when BD is reset). |
| 0 × 03 | → | CONTROL REQUEST | Illumination value | lamp on/off control is performed. |
| 0 × 05 | → | DIMMING REQUEST | Illumination value | lamp brightness is controlled. |
| 0 × 04 | → | STATUS REQUEST | None | 0xC4 requests illumination value from the RS-485 device. |
| 0 × 10 | ← | STATUS RESPONSE | Illumination value | Response to current illumination value is made. |
| 0 × 12 | → | Recover Saved | 0 × 00 , 0 × FF | If 0xff is set, this means that lamp is turned on using stored dimming value. If 0x00 is set, illumination is turned off. |
| 0 × 20 | → | Set Dimming Speed | 0~0 × FFFFFFFF | If I is set, dimming value is increased or reduced by 3 per 1ms, and a basic value is set to 2 (dimming value is changed by 3 per 2ms). |
| 0 × FD | → | alive check REQUEST | None | ALIVE RESPONSE is responded such that it is confirmed whether or not dimming connector is alive. |
| 0 × FD | ← | alive check RESPONSE | Error situation ErrorCode, Others 0 × 00000000 | This means alive dimming connector. BD updates DIB If SMPS error occurs, 0xFF000001 is responded. |
| 0 × 30 | → | Version REQUEST | | DC version is requested. |
| 0 × 30 | ← | Version RESPONSE | Version value | DC version is responded, VERSION value is assigned 2 bytes. Version value is composed of high-order 8 bits, 4 bits, and 4 bits ex) 0x0123 = v.1.2.3 |

LIGHTING SYSTEM AND METHOD FOR CONTROLLING THE SAME

CROSS-REFERENCE TO RELATED APPLICATION(S)

This application claims priority under 35 U.S.C. §119 to Korean Application No. 10-2011-0026986 filed in Korea on Mar. 25, 2011, whose entire disclosure is hereby incorporated by reference.

BACKGROUND

1. Field

A lighting system and method for controlling the same are disclosed herein. The lighting system and method of the present disclosure allows a more efficient utilization and conservation of energy resources.

2. Background

Lighting systems and methods for controlling the same are known. However, they suffer from various disadvantages.

BRIEF DESCRIPTION OF THE DRAWINGS

The embodiments will be described in detail with reference to the following drawings in which like reference numerals refer to like elements wherein:

FIG. 9 illustrates a format of a data packet according to an embodiment of the present disclosure;

FIG. 10 shows information related to command codes contained in a packet frame according to an embodiment of the present disclosure;

DETAILED DESCRIPTION

In general, incandescent lamps, discharge lamps, and fluorescent lamps are used most commonly as light sources for various purposes, such as domestic, landscape, industrial, or other appropriate types of lighting applications. These types of light sources suffer from various disadvantages such as poor efficiency and large amounts of heat generation (e.g., incandescent lamps), high price and high operational voltage (e.g., discharge lamps), and may be harmful to the environment due to their use of mercury (e.g., fluorescent lamps).

Light emitting diode (LED) based light sources may overcome the drawbacks of these light sources. LEDs have advantages in efficiency, flexibility to emit light in a variety of colors, autonomy of design, and so on. The LED is a semiconductor device which emits light when a forward voltage is applied thereto. LEDs have a greater lifespan, lower power consumption, and electric, optical, and physical characteristics which are suitable for mass production when compared to incandescent, discharge, or fluorescent types of light sources.

Moreover, in a large building, a lighting system may include a large number of light sources. The lighting system as broadly disclosed and embodied herein may automatically assign a unique address to the plurality of lighting apparatuses and control the lighting apparatuses using the unique addresses to enable a more efficient management and operation of the lighting system. The lighting system may automatically detect and configure replaced or newly added lighting apparatuses to assign a new address. The lighting system and method for controlling and managing the same as disclosed herein allows a more efficient utilization and conservation of energy resources.

Figure 1:
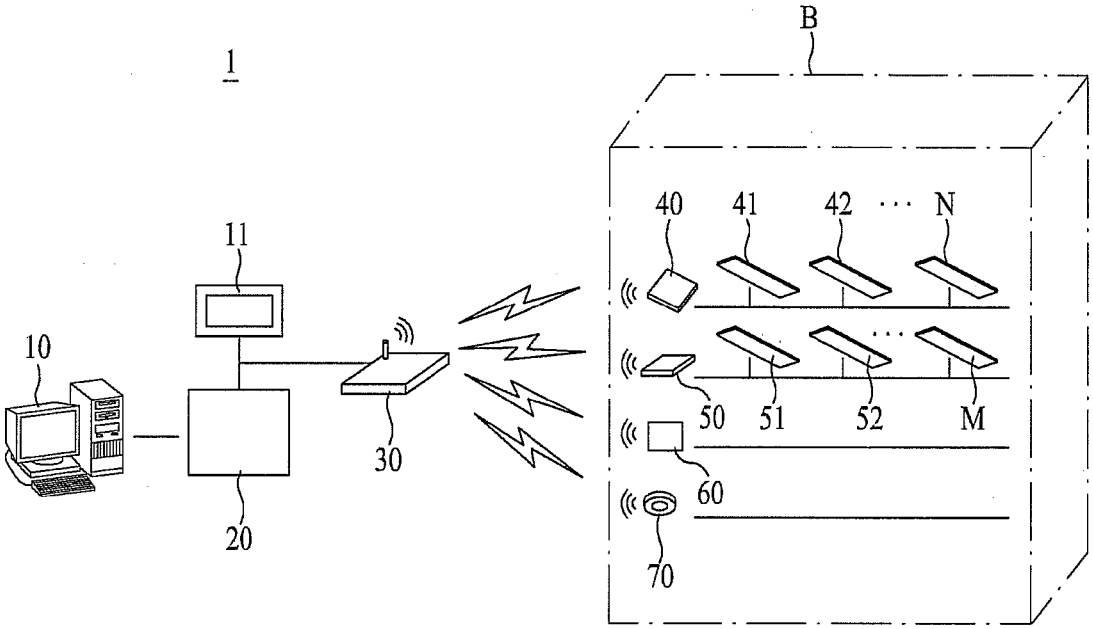
FIG. 1 is a schematic diagram of a lighting system according to an embodiment of the present disclosure.
Figure 2:
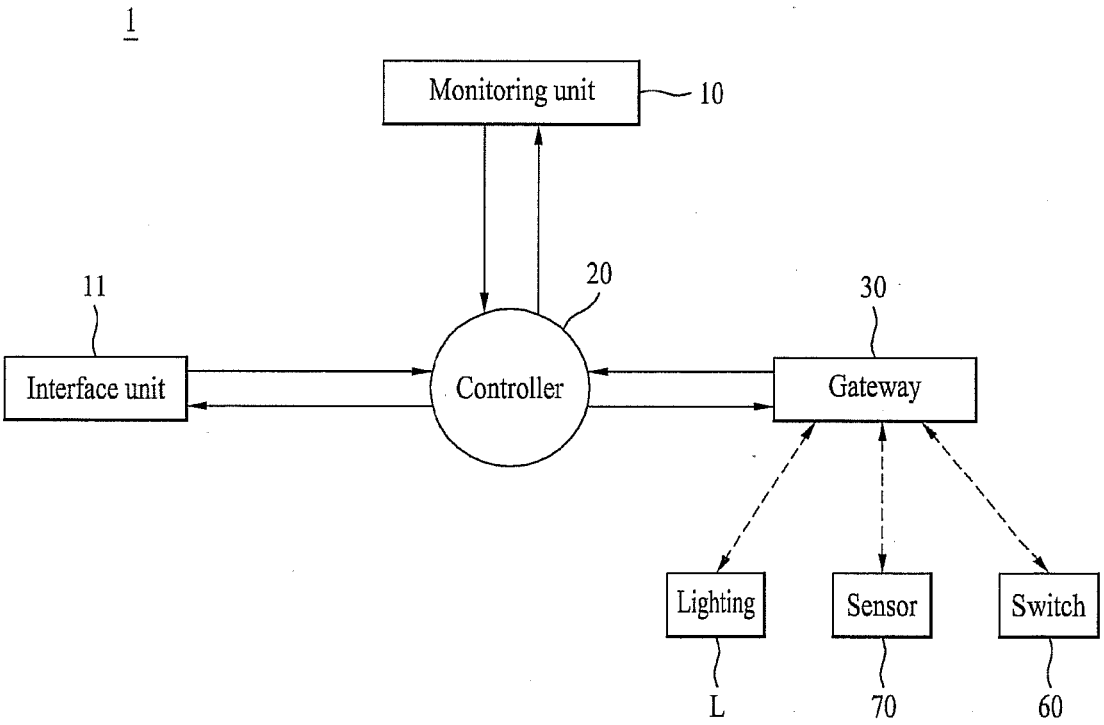
FIG. 2 is a block diagram of the lighting system of FIG. 1.

FIG. 1 is a schematic view of a lighting system and FIG. 2 is a block diagram of the lighting system in accordance with an embodiment of the present disclosure. The lighting system 1 may include a terminal 10, an interface 11, a lighting controller 20, a gateway 30, bridge devices 40, 50, a plurality of lighting apparatuses 41 to N, 51 to M (N, M=a positive integer) connected to the bridge devices 40, 50 to enable communication, a program switch 60, and a sensor 70. It should be appreciated that the lighting system 1 may include various combinations of the elements which are shown in FIG. 1.

The terminal 10 may be connected to the lighting controller 20 to control the lighting part L. The lighting part L may include one or more of the bridge devices 40, 50, the lighting apparatuses 41 to N, 51 to M, the program switch 60, or the sensor 70. The terminal 10 may be connected to the lighting controller 20 to communicate over one or more of a Transfer Control Protocol/Internet Protocol (TCP/IP), a Simple Object Access Protocol/Extensible Mark-up Language (SOAP/XML), a Building Automation and Control Network (BACnet), or another appropriate type of protocol to exchange information within the lighting system 1.

The terminal 10 may store setup information for the lighting part L. The terminal 10 may manage state information and power consumption in real-time, including turning the lighting apparatuses 41 to N, 51 to M on/off or changing the light intensity of the lighting apparatuses 41 to N, 51 to M mounted in a particular zone. The terminal 10 may also detect areas which may be using unnecessary energy to minimize waste, manage equipment in the building, manage maintenance of equipment operation, manage maintenance of an inside environment of the building, manage energy and materials consumed through the above management operations, or the like. The terminal 10 may also initiate configuration of the lighting apparatuses 41 to N, 51 to M, for example, to initialize the addresses of one or more of the lighting apparatuses 41 to N, 51 to M.

The terminal 10 may be a desktop computer, a laptop, a display panel, a Personal Digital Assistance (PDA), a tablet, or another appropriate type of device capable of performing the management functions. The terminal 10 may be connected over a distributed network through an appropriate type of network protocol (e.g., TCP/IP). The terminal 10 may be connected via wired or wireless connections. Moreover, the terminal 10 may be a Web server connected over the Internet to remotely control and manage the lighting part L.

In certain embodiments, a plurality of terminals 10 may be provided such that each terminal 10 may perform the management functions to control the lighting system 1. In this case, the plurality of terminals 10 may communicate with each other to synchronize information related to the management of the lighting system 1 such as operating schedules, or the like.

The interface 11 may be a display panel for inputting control inputs or displaying state information of the lighting system 1. The interface 11 may have a form factor which is smaller in size when compared to the terminal 10 which may allow the interface 11 to be easily installed throughout the building B. For example, the interface 11 may have a size and shape suitable to be wall mounted or used as a mobile device. The interface 11 may be provided on each floor or zone in the building B to receive control inputs from a user and to display a Graphical User Interface (GUI) for controlling and monitoring the lighting apparatuses 41 to N, 51 to M in the lighting system 1.

The display of the interface 11 may be a touch screen display. The interface 11 may communicate with the lighting controller 20, for example, to transmit inputs received through the GUI to the lighting controller 20 for controlling various groups/zones of lighting apparatuses. For example, the interface 11 may transmit control information to the lighting controller 20 to control an individual lighting apparatus or a group of lighting apparatuses such as an entire floor or building. The interface 11 may also receive status information, or the like, from the lighting controller 20. The interface 11 may display the received information on the GUI.

It should be appreciated that, while the interface 11 is described hereinabove as a display panel, the present disclosure is not limited thereto. For example, the interface 11 may be configured to have the same functionality as the terminal 10. The interface 11 may be a desktop terminal (e.g., a desktop computer), laptop, PDA, tablet, or another appropriate type of computing device. Moreover, while the terminal 10 and the interface 11 have been disclosed as being connected through the lighting controller 20, it should be appreciated that the terminal 10 and interface 11 may be connected such that signals are not necessarily routed through the lighting controller 20. For example, the terminal 10 and the interface 11 may be directly connected to each other or connected in a distributed network configuration with the lighting controller 20. Moreover, the interface 11 may be configured to communicate over various types of communication protocols, similar to the terminal 10 as previously described.

Moreover, one or more of the terminals 10 or the interfaces 11 may be configured as a management terminal while the remaining terminals 10 or interfaces 11 may be configured as user interfaces for state monitoring and for inputting user commands. A management terminal may be configured to have additional functionality than the remaining terminals, such as the capability to initiate assignment of addresses for the lighting apparatuses, configure zones or control groups to control a group of lighting, centrally store scheduling or user preference information, or the like.

The lighting controller 20 may be provided to control the operation of the lighting apparatuses 41 to N, 51 to M based on received inputs or an operational state of the lighting part L. The lighting controller 20 may be connected to the terminal 10, the interface 11, and the gateway 30. The lighting controller 20 may receive various control inputs for controlling the lighting apparatuses 41 to N, 51 to M from the terminal 10 or interface 11 and transmit appropriate control signals to the gateway 30 to control the lighting part L. The lighting controller 20 may receive monitoring information from the sensor 70. The lighting controller 20 may directly control the lighting apparatuses 41 to N, 51 to M based on the received monitoring information and/or forward the monitoring information to the terminal 10 and interface 11 for processing and display thereon.

The lighting controller 20 may communicate with the monitoring terminal 10 or the interface 11 using various types of protocols, for example, SOAP or BACnet protocols in which XML based messages are exchanged over a network using HyperText Transfer Protocol (HTTP), Hypertext Transfer Protocol over Secure Socket Layer (HTTPS), Simple Mail Transfer Protocol (SMTP), or another appropriate type of protocol.

Moreover, the lighting controller 20 may store the addresses for each lighting apparatus 41 to N, 51 to M as well as the switch 60 and sensor 70. The lighting controller 20 may also store user preference information, scheduling information, zone or control group information, or another appropriate type of information to control and manage the lighting system 1. The lighting controller 20 may also control address configuration for the plurality of lighting apparatuses 41 to N, 51 to M through the gateway 30 and the bridge devices 40, 50. For example, the lighting controller 20 may generate data packets including address information for setting the address in each of the lighting apparatuses. In certain embodiments, the bridge devices 40, 50 may be configured to control address configuration for the lighting apparatuses 41 to N, 51 to M, as described in further detail hereinafter. Moreover, the lighting controller 20 or the bridge devices 40, 50 may include an address assigning device for controlling the address assigning process including generating the addresses for the lighting apparatuses 41 to N, 51 to M.

The lighting controller 20 may be installed separately or may be integrated into a terminal 10. For example, the terminal 10 may be configured as a central management terminal and installed in a main equipment room or at a remote location outside the building B and the lighting controller 20 may be mounted on each floor of the building B. Alternatively, the terminal 10 and the lighting controller 20 may be integrated and installed as a single apparatus.

The gateway 30 may communicate with the lighting controller 20 to receive control signals from the lighting controller 20 for group/individual lighting control. The gateway 30 may forward the received control signals to the lighting part L (e.g., bridge device, lighting apparatus, switch, or sensor) to control the same. The gateway 30 may also relay messages from the lighting part L to the controller 20. The gateway 30 may communicate with the lighting controller 20, the bridge devices 40, 50, the switch 60, or sensor 70 over a wireless or wired connection. The gateway 30 may be configured to communicate with the controller 20 over TCP/IP or another appropriate type of communication protocol. In one embodiment, the gateway 30 may be a Zigbee gateway.

A plurality of bridge devices 40, 50 may be connected to the gateway 30 and the plurality of the lighting apparatuses 41 to N, 51 to M to enable communication therewith for transmitting the control signals from the gateway 30 to the lighting apparatuses 41 to N and 51 to M. The bridge devices 40, 50 may also transmit a response or event information from the lighting apparatuses 41 to N, 51 to M to the gateway 30.

Moreover, the bridge devices 40, 50 may be configured to control the address configuration for the lighting apparatuses 41 to N, 51 to M.

The plurality of bridges 40, 50 may each be connected to a group of lighting apparatus. For example, the first bridge device 40 may be connected to a first group of lighting apparatuses 41 to N and the second bridge device 50 may be connected to a second group of lighting apparatuses 51 to M to enable communication therewith. The bridge devices 40, 50 may be connected up to a prescribed maximum number of lighting apparatuses. In one embodiment, the bridge devices 40, 50 may be connected up to 12 lighting apparatuses.

The bridge devices 40, 50 may be connected to the gateway 30 using the Zigbee specification. The bridge devices 40, 50 may be connected to the lighting apparatuses 41 to N, 51 to M using the RS-485 protocol which is a serial communication protocol. An input received, for example, at the interface 11 may be transmitted to the lighting controller 20, the gateway 30, and the corresponding bridge device 40, 50 in succession. The bridge device 40 may transmit the received commands to the appropriate lighting apparatus through the serially connected lighting apparatuses 41 to N. Likewise, the bridge device 50 may forward the commands to an appropriate lighting apparatus 51 to M serially connected thereto. For example, a command to turn off lighting apparatus 42 may be serially transmitted through lighting apparatus 41.

A response from the lighting apparatuses 41 to N, 51 to M may be transmitted to a corresponding bridge device 40, 50, the gateway 30, the lighting controller 20, and the terminal 10 and the interface 11, in succession. For example, data packets from the lighting apparatus 42 may be transmitted to lighting apparatus 41 and then to bridge device 40 over the RS-485 protocol. The data packets may then be forwarded to gateway 30 using Zigbee specification.

In accordance with the present disclosure, the bridge device 40, 50 may generate address data and transmit data packets including the address data to each serially connected lighting apparatuses 41 to N, 51 to M for configuring the addresses. The bridge device 40, 50 may convert received data packets into a format compatible with the destination lighting apparatus 41 to N, 51 to M. The bridge device 40, 50 may also format data received from the lighting apparatus 41 to N, 51 to M in a format compatible with the lighting controller 20. Alternatively, the address data may be generated in the controller 20 rather than in the bridge device 40 and transmitted to a corresponding lighting apparatus 41 to N, 51 to M through the bridge device 40.

The lighting apparatuses 41 to N, 51 to M may be one of a plurality of types of light sources including, for example, an LED type light source. The lighting apparatuses 41 to N, 51 to M provided in the building B may be a flat type or a bulb type light source. The lighting apparatuses 41 to N, 51 to M may include or more LEDs which have a color rendition which is higher than Ra 75, and an efficiency which is higher than 65 Im/W.

The lighting apparatuses 41 to N, 51 to M may be connected in series over the RS-485 protocol. Each lighting apparatus 41 to N, 51 to M may be configured to intercept or forward a control command received from a previous device. For example, a control command to initiate address configuration may be intercepted by a lighting apparatus to set a new address or transmitted in series to a subsequent lighting apparatus. The lighting apparatuses 41 to N, 51 to M may also include circuitry to control light intensity of the LEDs (e.g., dimming).

The building B may include a switch 60 to control one or more of the lighting apparatuses 41 to N, 51 to M (e.g., dimming or to turn the lighting apparatuses on/off), and a sensor 70 to sense light intensity, or the like. The switch 60 and sensor 70 may be integrated into the lighting apparatuses 41 to N, 51 to M or installed separately in the building B.

It should be appreciated that the connection scheme between the bridge devices 40, 50 and the gateway 30 may be the same as the connection scheme between the bridge devices 40, 50 and the lighting apparatuses 41 to N, 51 to M. For example, the bridge devices 40, 50 and the lighting apparatuses 41 to N, 51 to M may be configured to communicate according to the Zigbee standard. Simply for ease of description, however, the connection between the bridge devices 40, 50 and the lighting apparatuses 41 to N, 51 to M is described herein as being connected over the RS-485 protocol.

Moreover, it should be appreciated that the lighting system 1 may include a combination of the previously disclosed elements and is not limited to the configuration as illustrated in FIGS. 1 and 2. Furthermore, the lighting system 1 may be implemented as a hybrid solution as well as a legacy solution to interface with legacy lighting apparatuses.

For example, the hybrid solution may include a combination of devices, as shown in FIGS. 1 and 2. That is, the hybrid solution may include one or more bridge devices 40, 50, gateways 30, lighting apparatuses 41 to N, 51 to M, switches 60, and/or sensors 70. Alternatively, a legacy solution may include a lighting controller 20 connected according to a third-party protocol scheme to various combinations of a Network Control Unit (NCU), a Lighting Interface Unit (LIU), a Central Processing Unit (CPU), a Transmission Unit (TU), a relay, a program switch, etc. The address initialization of the lighting apparatuses as broadly disclosed and embodied herein may be applicable to legacy lighting apparatuses.

Figure 3:
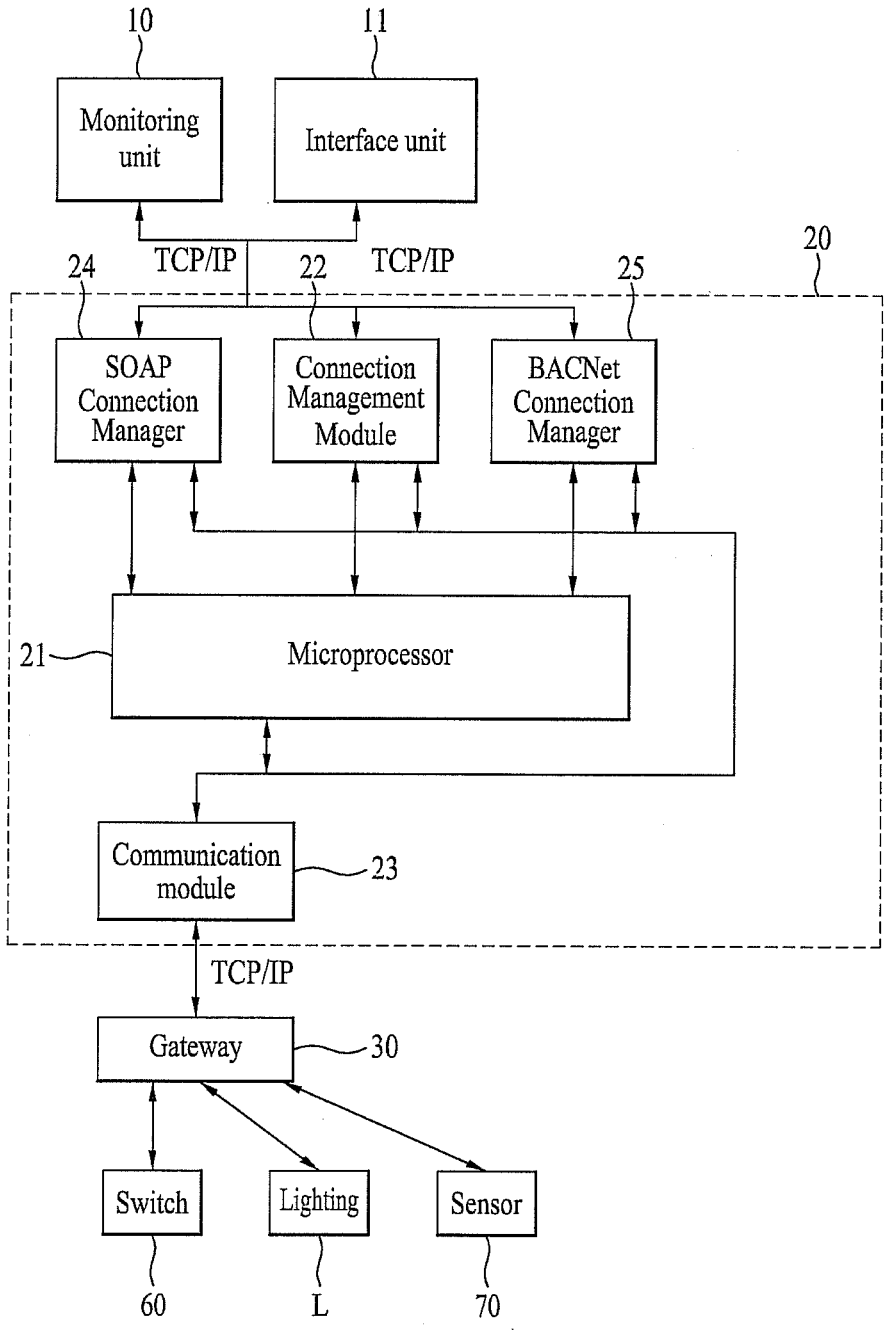
FIG. 3 is a block diagram of a central lighting controller according to an embodiment of the present disclosure.

FIG. 3 is a block diagram of the central lighting controller 20 of FIGS. 1 and 2. The controller 20 may include a microprocessor 21, a connection management module 22, a communication module 23, a SOAP connection manager 24, and a BACnet connection manager 25.

The microprocessor 21 may be configured for processing data for controlling the lighting part L. The microprocessor 21 may receive commands from the terminal 10 or interface 11 through the SOAP connection manager 24 and/or the BACnet connection manager 25. The microprocessor 21 may process the received commands to generate a control data packet and transmit the generated control data packet to the lighting part L through the communication module 23. Moreover, the microprocessor 21 may generate a response or event information related to the received commands and transmit the information to the terminal 10 or interface 11 through the connection management module 22.

The microprocessor 21 may perform group based control, individual based control, pattern control, schedule based control, power failure and power recovery control, illumination sensor interoperable control, or the like, for controlling and monitoring the lighting apparatus 41 to N, 51 to M, the switch 60, and/or the sensor 70.

The communication module 23 may control communication between the lighting controller 20 and the gateway 30. The communication module 23 may format or convert data received from the microprocessor 21 into a format compatible with the lighting apparatus 41 to N, 51 to M, the switch 60, or the sensor 70. The communication module 23 may transmit the formatted data to the gateway 30. The communication module 23 and the gateway 30 may transmit and receive, for example, TCP/IP packets. In addition, the communication module 23 may transmit to the microprocessor 21 a response or event information received from the gateway 30.

Upon receiving the control command from the terminal 10 or interface 11, a corresponding one of the connection management module 22, the SOAP connection manager 24, or the BACnet connection manager 25 may convert the received control command into an internal language capable of being recognized by the lighting controller 20. The formatted control command may then be transmitted to the microprocessor 21. That is, one of the connection management module 22, the SOAP connection manager 24, or the BACnet connection manager 25 may interpret or convert the data from a protocol corresponding to either the terminal 10 or the interface 11 to the required format.

Figure 4:
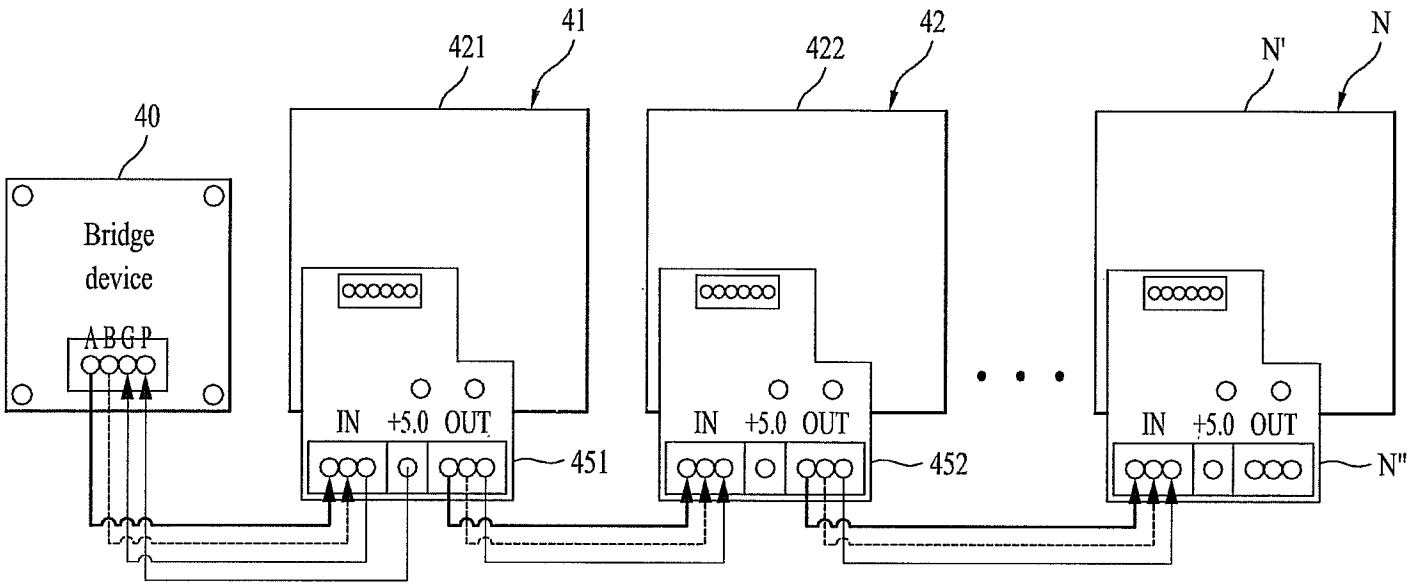
FIG. 4 is a diagram illustrating a connection between a bridge and a plurality lighting apparatuses according to an embodiment of the present disclosure.

FIG. 4 is a diagram illustrating a connection between a bridge device and a plurality of lighting apparatuses according to an embodiment of the present disclosure. Simply for ease of description, reference is made hereinafter to the bridge device 40 and corresponding lighting apparatuses 41 to N of FIG. 1. It should be appreciated, however, that the present disclosure is not limited thereto and may be applicable to a various combination of multiple bridge devices and lighting apparatuses.

The bridge device 40 may be serially connected to lighting apparatus 41, and lighting apparatus 41 may be serially connected to lighting apparatuses 42 and 43, as shown. The bridge device 40 may be configured as a master device and the lighting apparatuses 41 to N may be configured as a slave device. The bridge device 40 may be connected to the lighting apparatuses 41 to N using the RS-485 communication protocol. However, as previously described, it should be appreciated that the scope or spirit of the present disclosure is not limited to the RS-485 communication protocol and may also be equally or similarly applied to other communication protocols as necessary.

The lighting apparatuses 41 to N may each include a corresponding light emitting module 421 to N' and a connection module 451 to N". Each light emitting module 421 to N' may be connected to a corresponding connection module 451 to N". The connection module 451 to N" may provide power and control signals to the light emitting module 421 to N' to control the operation of the LEDs. Moreover, the bridge device 40 and each of the lighting apparatuses 41 to N may be connected in series through the connection modules 451 to N" of the respective lighting apparatuses 41 to N. The connection modules 451 to N" may include a connection circuit to control a data connection to a subsequent connection module. The connection modules 451 to N" may also be referred to herein as a control circuit or a connection controller.

The bridge device 40 may be connected to the connection module 451 of the first lighting apparatus 41, and the connection module 451 may be connected to the next connection module 452 of the second lighting apparatus 42, and so on. The bridge device 40 may be hardwired to the connection modules 451 to N". The bridge device 40 may assign a unique address to the lighting apparatuses 41 to N through the wired data lines. The bridge device 40 may control the lighting apparatuses 41 to N using the unique addresses.

In association with the above-mentioned description, provided that the bridge device 40 is connected in series to the connection modules 451 to N" of each lighting apparatus 41 to N according to the RS-485 communication protocol, an address assignment procedure for each lighting apparatus may be executed for group or individual control of the lighting apparatuses 41 to N. The address assigned to each lighting apparatus 41 to N may be unique within at least a specific region or area, e.g., floor or room. Here, it may be necessary that each lighting apparatus in the particular region have a unique address for individual control of each lighting apparatus.

The bridge device 40 and each connection module 451 to N" may support the RS-485 communication protocol, and include a plurality of ports or connectors for connecting power and data according to the RS-485 communication protocol. For example, the bridge device 40 may include a port for power and data connection to the connection module 451 of the first lighting apparatus 41. The connection modules for each subsequent lighting apparatuses connected in series may include an input and output ports for connection to the bridge device 40 through a connection module of a previous lighting apparatus. The input, output, and power ports may include at least one terminal and may include a variety of types of connectors.

For example, the bridge device 40 may include a port having terminals for two input lines and two output lines. The bridge device 40 may include a terminal P for receiving power from the first connection module 451 of the first lighting apparatus 41. The bridge device 40 may also include data terminals A, B to exchange data with the first connection module 451. The bridge device 40 may also include a ground terminal G.

The first connection module 451 of the first lighting apparatus 41 may include an input port, an output port, and a power port. The power port on the connection module 451 may be connected to the power terminal P of the bridge device 40 for supplying power thereto. The output power generated by the first lighting apparatus 41 may have, for example, a voltage level of +5V. The input port of the first lighting apparatus 41 may have three terminals for connection to the bridge device 40 including one ground and two data terminals. These terminals on the input port may be connected to the ground port G and data ports A and B on the bridge device 40, respectively. The output port of the connection module 451 may also include three terminals, one ground and two data terminals. These output terminals may be connected to the corresponding terminals on the input port of a subsequent connection module (e.g., the connection module 452 of the second lighting apparatus 42).

As described above, the connection modules 451 to N" may transmit data received from a previous device to a subsequent device without change. For example, each connection module 451 to N" may relay received data to a connection module of a subsequent lighting apparatus according to the RS-485 communication protocol. Hence, data transmitted from the bridge device 40 may be serially transmitted to each of the plurality of lighting apparatuses 41 to N. Moreover, as described in further detail with reference to FIG. 7 hereinafter, each connection module 451 to N" may analyze a received data packet and control the data connection to a subsequent connection module based on the analysis.

Figure 5:
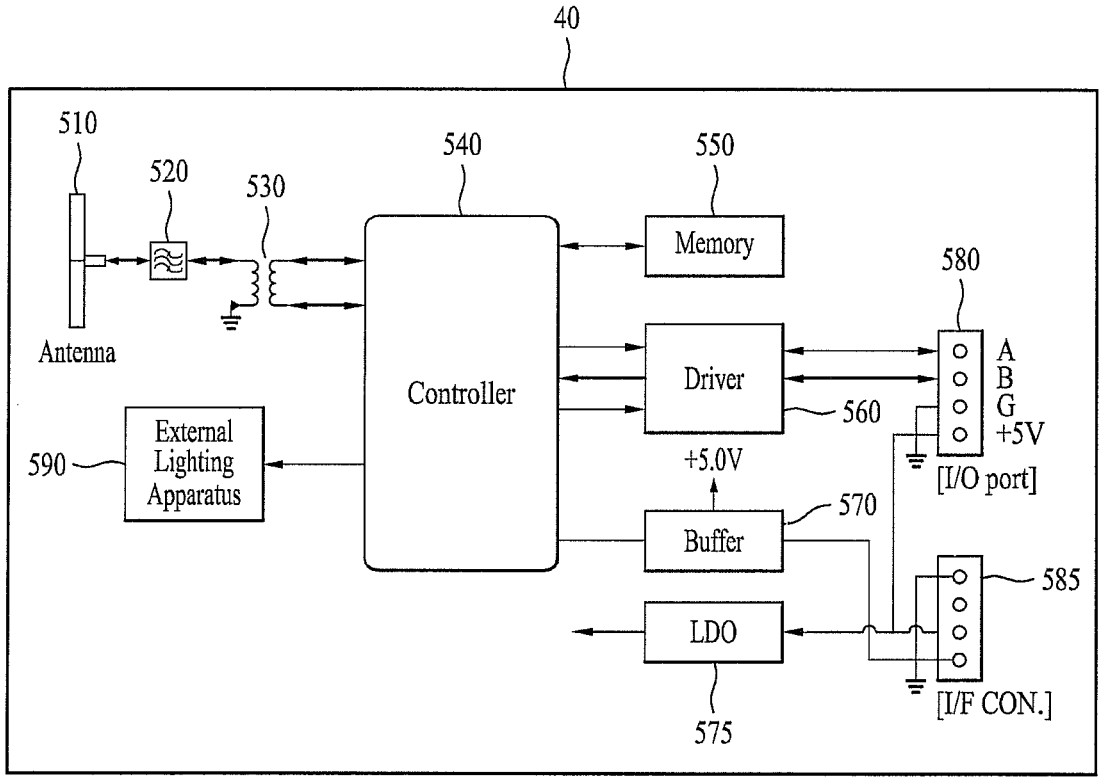
FIG. 5 is a schematic diagram of a connection module of a bridge according to an embodiment of the present disclosure.

FIG. 5 is a schematic diagram of a bridge device. The bridge device 40 may include an antenna 510, a filter 520, a transformer 530, a controller 540, a memory 550, a driver 560, a buffer 570, a low drop-out regulator (LDO) 575, an input/output (I/O) port 580, and an interface (I/F) connector 585. In addition, the bridge device 40 may communicate with an external lighting apparatus 590.

The antenna 510 may transmit and receive radio frequency (RF) signals from the gateway 30. The filter 520 may remove output harmonic components through a low pass filter (LPF). The filter 520 may also filter high frequency components through the LPF.

The transformer 530 may be implemented as a 'balance to unbalance transformer' (Balun) having a higher conversion rate when a high impedance balanced antenna is matched to a low impedance unbalanced receiver, transmitter, or transceiver. For example, a signal for the transformer 530 may be configured as a 100Ω differential signal. The 100Ω impedance may be converted to 50Ω impedance through an antenna according to transmission/reception (Tx/Rx) signals, and only the 2.4 GHz band signals may be filtered out.

The controller 540 may be a 2.4 GHz ZigBee wireless communication transceiver System on Chip (SoC) including an IEEE 802.15.4 MAC/PHY. The controller 540 may further include a processor, a flash memory (or SRAM), and an encryption module. Furthermore, the controller 540 may use an SPI (Ethernet, EEPROM), a TWI (RTC module), or a Joint Test Action Group (JTAG) (SIF) interface.

The memory 550 may include an Electrically Erasable Programmable Read-Only Memory (EEPROM) acting as a non-volatile memory. For example, the memory 550 may have a storage capacity of 128 Kbytes, and may be used as a temporary data ROM (DataROM) when ZigBee firmware is wirelessly updated.

The driver 560 may enable long distance communication with an external device through a differential line according to a half duplex scheme for use in Universal Asynchronous Receiver/Transmitter (UART) communication. The buffer 570 may adjust brightness of an external device (e.g., a connection module) using a Pulse Width Modulation (PWM) scheme such as a 500 Hz pulse width modulation scheme. The LDO 575 may convert an input power supply voltage of 5V DC to a constant voltage of 3V DC to power components requiring 3V DC, such as a ZigBee chip.

The I/O port 580 may be connected to a plurality of lighting apparatuses through RS-485 communication based on the half-duplex scheme, such that it can independently control each of the plurality of lighting apparatuses. In one embodiment, the bridge device 40 may be connected up to 12 light emitting apparatuses. The I/O port 580 may receive an input voltage (e.g., 5V DC) through an external device to power internal circuits.

The I/F connector 585 may be connected to the 5V DC on the I/O port 580, the LDO 575, and the buffer 570. The I/F connector 585 may receive the 5V DC power through the external device (e.g., the connected connection module 451), and may output a PWM signal of 5V, such that light dimming is achieved by PWM control.

If necessary, the bridge device 40 may be configured to include a function for testing a connection state between devices or a memory fusing function. In addition, the bridge device 40 may include a JTAG Connector to download and debug ZigBee software (SAN).

Figure 6:
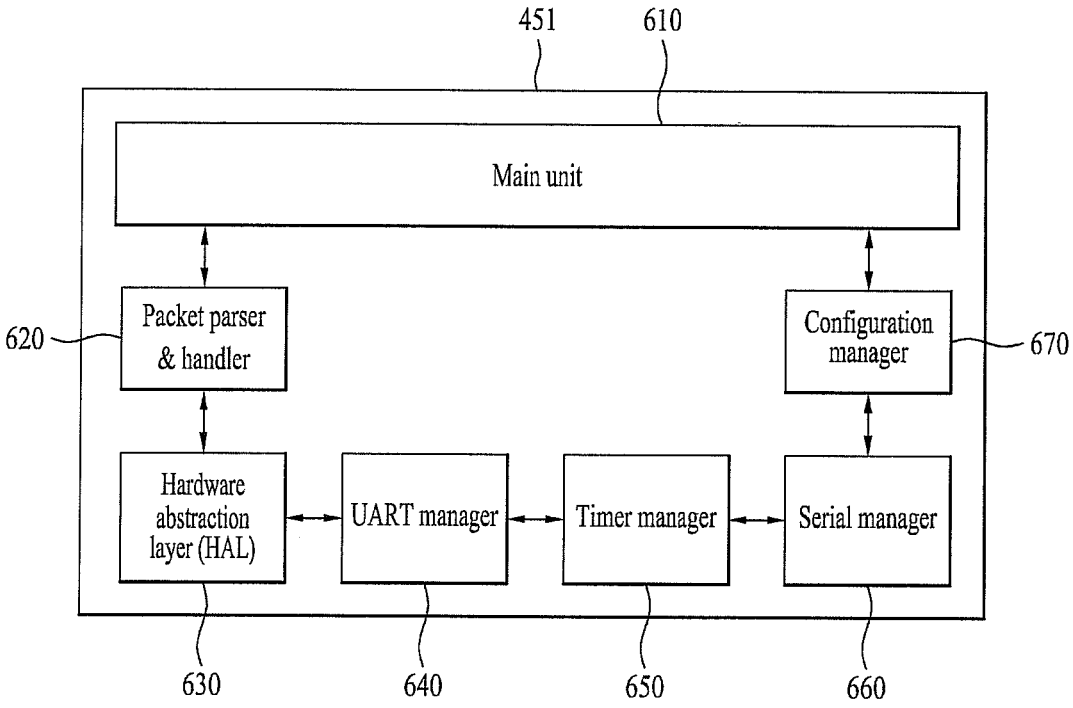
FIG. 6 is a logical block diagram of a connection module of a lighting apparatus according to an embodiment of the present disclosure.

FIG. 6 is a logical block diagram of a connection module of a lighting apparatus according to an embodiment of the present disclosure. The connection module 451 of lighting apparatus 41, taken as an example, may include a main module 610, a packet parser & handler 620, a hardware abstraction layer (HAL) 630, a UART manager 640, a timer manager 650, a serial manager 660, and a configuration manager 670.

The main module 610 may control the operation of the lighting apparatuses, and provide the infrastructure to implement a connection, communication, and control of the elements of the lighting apparatuses. The packet parser & handler 620 may parse RS-485 packets including at least one of a control data or address data which is transmitted from the bridge device 40, and may process data contained in the parsed RS-485 packets.

The HAL 630 is an aggregate (or set) of routines to process hardware-dependent items needed for implementing the I/O interface, interrupt control, and multi-processor communication, and may provide necessary interfaces and routines under control of the main module 610. The UART manager 640 communicates with an external device through a differential line according to a half-duplex scheme for use in UART communication.

The timer manager 650 manages timing related to processing of control data and address data that are input through the bridge device 40. The serial manager 660 transmits and receives RS-485 packets. The configuration manager 670 may include a memory to store a variety of information for configuring individual constituent elements.

Figure 7:
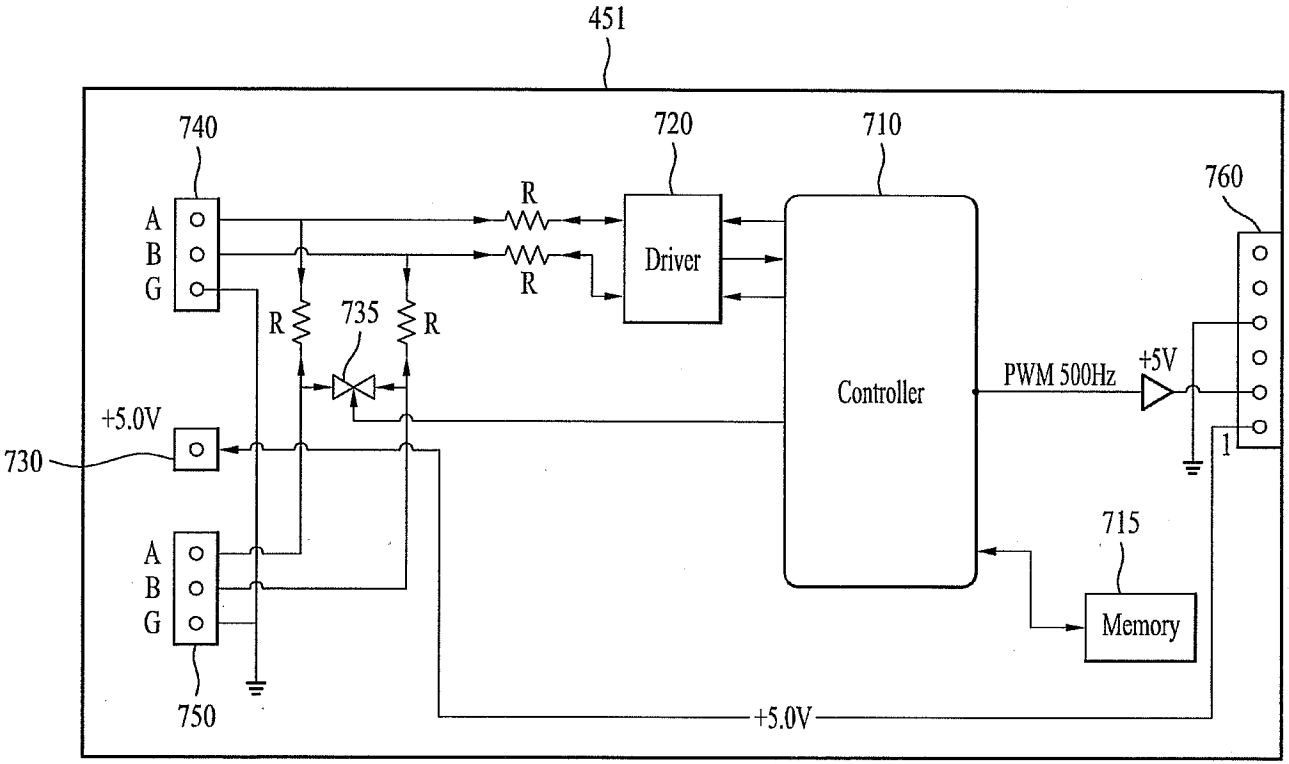
FIG. 7 is a schematic diagram of a connection module of a lighting apparatus according to an embodiment of the present disclosure.

FIG. 7 is a schematic diagram of a connection module of a lighting apparatus according to an embodiment of the present disclosure. The connection module 451 may include a controller 710, a driver 720, a power port 730, a connection control circuit 735, an input port 740, an output port 750, and an output port 760 to the light emitting module 421. The controller 710 may provide an infrastructure for controlling the entirety of the lighting apparatus 41 and establishing a connection for data communication with neighboring bridge devices 40 or lighting apparatuses.

The controller 710 may control the operation of the light emitting module 421. The controller may process data received through the input port 740 and driver 720 for operation of the lighting apparatus 41 as well as address assignment and other configuration processes. The controller 710 may store various types of data in the memory 715, such as an assigned address for the lighting apparatus 41.

The input port 740 may be connected to either the serially connected bridge device 40 or an output port of a different lighting apparatus, such that it can receive a variety of control data and address data. The input port 740 may include one line connected to a ground terminal and two lines used to receive data.

The output port 750 may transmit data received through the input port 740 to an input port of a subsequent, serially connected lighting apparatus 42. The output port 750 may include one line connected to a ground terminal and two lines which may be used to transmit data.

The two data lines on the output port 750 may be connected to the two data lines on the input port 740. For example, a signal path may be provided through the connection module 451 to connect the input port 740 to the output port 750. The connection control circuit 735 may be positioned between the input port 740 and the output port 750 across the data lines, and configured to control the connection state of the data lines between the input and output ports 740 and 750.

For example, the connection control circuit 735 may be positioned between the input port 740 and the output port 750 of the lighting apparatus 41, across terminals A and B at the output port 750. In order to terminate the connection to the next lighting apparatus 42, the connection control circuit 735 may electrically short circuit the data lines between terminals A and B at the output port 750 based on a control signal from the controller 710. That is, the difference in voltage between output terminals A and B is no longer present, and therefore, data signals cannot be transmitted through the output port 750 to the subsequent lighting apparatus 42. The data lines at the input port are not affected by the connection control circuit 735 and data may be received at the input port while the output port is disconnected. Each of the lighting apparatuses 42 to N may operate in a similar manner to control a connection state to a subsequent lighting apparatus. The connection control circuit 735 may be a switch, a diode, a relay, semiconductor devices, or another appropriate electric circuit. The connection control circuit 735 may also be implemented in the controller 710 to disable data output at the output port 750.

A second output port 760 may be provided to connect the connection module 451 to a corresponding light emitting module 421 of the lighting apparatus 41. The LEDs provided in the light emitting module 421 may be driven by a PWM signal generated by the controller 710. The PWM signal may be used to dim or otherwise adjust the light output levels of the LEDs. Here, the connection module 451 may also be referred to as a dimming connector.

Figure 8:
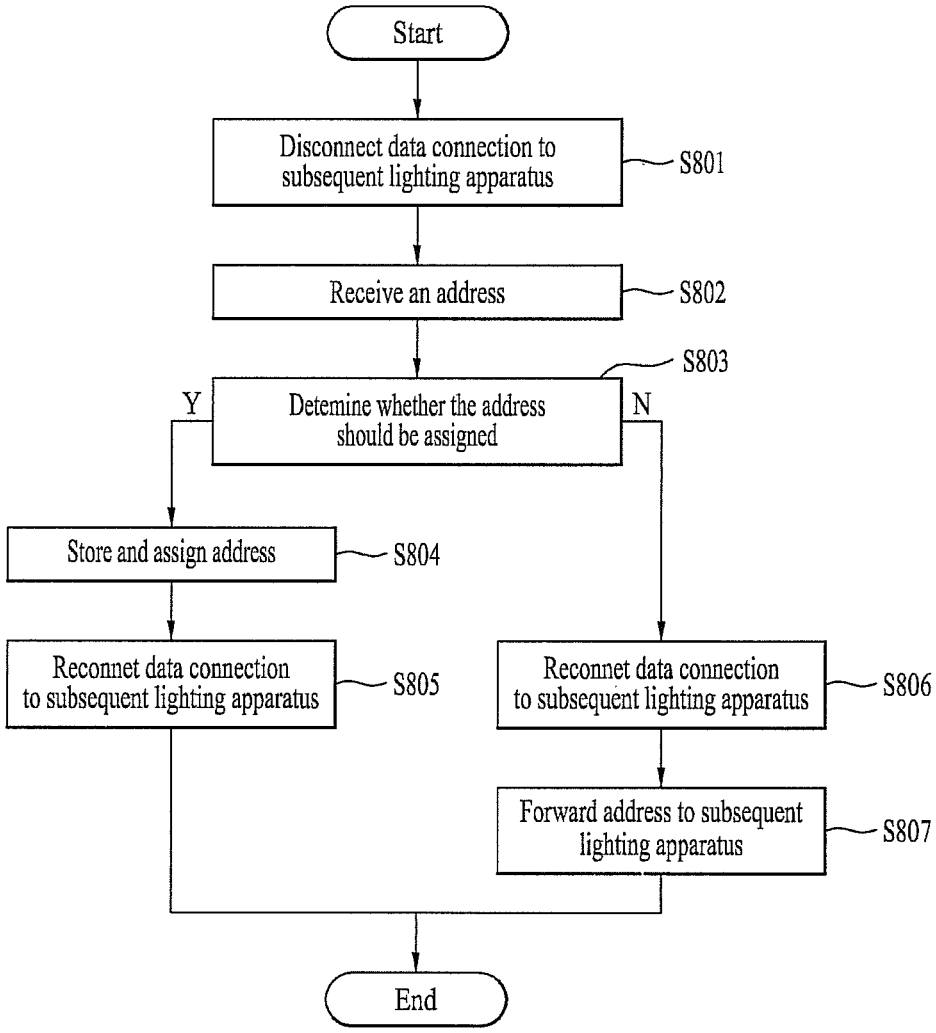
FIG. 8 is a flow chart of a method for controlling a connection module according to an embodiment of the present disclosure.

FIG. 8 is a flow chart of a method for controlling a connection module 735 according to one embodiment. In step S801, the data connection to a subsequent lighting apparatus may be disconnected in a lighting apparatus. For example, when a data packet is received at a lighting apparatus 41, the controller 710 of the lighting apparatus 41 may determine whether the data packet includes a command code for initiating address assignment. If the data packet is for initiating address assignment, the controller 710 may transmit the data packet to all of the serially connected lighting apparatuses 42 to N according to the RS-485 communication protocol. The controller 710 of each lighting apparatus 41 to N may then initiate a procedure for address assignment by temporarily severing the data connection to a subsequent lighting apparatus. In order to sever the data connection, the controller 710 may electrically short-circuit the data lines at the output port 750 using the connection control circuit 735 connected between the input port 740 and the output port 750. In one embodiment, once the data connection to the next lighting apparatus is disconnected, the controller 710 may clear any stored addresses from memory 715.

Thereafter, the bridge device 40 or the lighting controller 20 may transmit a second data packet to the lighting apparatus 41 that includes an address, in step S802. The second data packet may be generated after the initiation of the address assignment process. The controller 710 may determine whether the received address should be assigned to the lighting apparatus 41, in step S803. For example, the controller 710 may determine whether an existing address is stored in the controller 710 for the lighting apparatus 41. If an address is not stored, then the address is needed and the controller 710 processes the second data packet to assign and store the received address for the lighting apparatus 41, in step S804. The controller 710 then reestablishes the data connection to the next lighting apparatus 42 using the connection control circuit 735, in step S805.

If it is determined that an address exists, in step S803, the controller 710 may open the data connection to the subsequent lighting apparatus 42 using the connection control circuit 735, in step S806. The second data packet including the address is forwarded to the next lighting apparatus 42, in step S807. To reestablish the data connection to the next lighting apparatus 42, the controller 710 controls the connection control circuit 735 to be in an electrically open state such that the data connection between the input port 740 and the output port 750 is reestablished. The data packets received at the input port 740 may then be transmitted through the output port 750 to the subsequent lighting apparatus 42.

A subsequent data packet received at the lighting apparatus 41 after the address has been assigned and stored in the lighting apparatus 41 may be forwarded to the next lighting apparatus 42. For example, any data packet received once the address has been assigned may be forwarded to the next lighting apparatus without processing the data packet to assign or store any subsequently received address data.

Once the address assignment process has completed, the controller 710 of lighting apparatus 41 may use the assigned address to determine whether a control data received is intended for lighting apparatus 41. If the address in the received control data matches the stored address, the control data may be processed to control the lighting apparatus 41 based on the received control data.

The controller 710 in each lighting apparatus 42 to N may initiate the same process as described above for lighting apparatus 41 to initiate address assignment and to process control data.

FIG. 9 illustrates a format of a data packet according to an embodiment of the present disclosure. The data signal transmitted to the lighting apparatuses 41 to N may be configured as a data frame. For example, the data frame may include at least one of a start delimiter field, packet length field, destination address field, source address field, command code field, control value field, checksum field, and/or an end delimiter field.

The start delimiter may designate the beginning of a packet frame having a specific purpose, and the end delimiter may designate the end of a packet frame having a specific purpose, such that individual packet frames can be identified. Each of the start delimiter and the end delimiter may have a predetermined value. In FIG. 9, the start delimiter is denoted by 0x02 and the end delimiter is denoted by 0x03.

Moreover, the start delimiter may designate a start point of a packet frame and may operate as an identifier to identify the corresponding purpose of various packet frames. Therefore, a device that receives the packet frame may extract the start delimiter of the received packet frame to identify a specified purpose of the corresponding packet frame or to recognize the start point of the corresponding packet frame. As a result, the receiving device may accurately extract the necessary information from the received data frame to perform a desired operation.

The packet length field may include length information of the corresponding packet frame. In this case, packet length may designate a total packet length from the start delimiter to the end delimiter. Alternatively, the packet length may be a length of the corresponding packet frame located after the packet length field.

The destination address field may include destination address information of the corresponding packet frame, and the source address field may include source address information of the corresponding packet frame. If the device associated with the address is a bridge device, the assigned address may be '0x0000'. In addition, the destination address may be 2 bytes to designate a destination address (4~12 bits) and to make a distinction between Mode 0 and Mode 1 using a Most Significant Bit (MSB). For example, Mode 0 may be used to independently control each lighting apparatus (Private Control Mode), and Mode 1 may be used to control one or more lighting apparatus on a group basis (Group Control Mode).

The command code field may include a command code corresponding to a purpose of the corresponding packet frame. The command code may correspond to a particular command and indicate the purpose of the corresponding packet frame. For example, the corresponding packet frame information may identify an address assignment type data packet or a control information type data packet using the command code field. The lighting apparatus may perform an operation based on the command code.

The control value field may include a specific value indicating attributes of control content defined in the corresponding packet frame corresponding to at least one of the destination address or source address. The control value field may have a value dependent upon the command code information. Moreover, the checksum field may include a checksum for the corresponding packet frame. The checksum may be used to check for errors in the packet frame.

FIG. 10 shows information related to command codes contained in a packet frame according to an embodiment of the present disclosure, including exemplary definitions of various command codes and control values. The command codes may be classified into those related to an address assignment function and those related to a control function of the lighting apparatuses.

The column labeled 'CC' shows command codes which may be included in the CC field in the packet frame, and 'Value' designates control values which may be included in the Value field in the packet frame of FIG. 9. The column labeled 'Direction' shows the direction of data transmission between the bridge device 40 and the lighting apparatus 41 to N. A right arrow indicates data transmission from the bridge device 40 to the lighting apparatuses and a left arrow indicates data transmission from the lighting apparatuses to the bridge device 40. In addition, the column labeled 'Function' corresponds to a title or name of a corresponding command code, and 'Note' includes a description of the command code. In FIG. 10, a function that includes the term 'JOIN' in the 'Function' column corresponds to the address assignment process.

A JOIN Reset packet frame that includes a command code '0xC5' may be generated at the bridge device 40 or the lighting controller 20 for transmission to the lighting apparatuses 41 to N. The JOIN Reset packet may be used to initiate the address assignment process. This packet may be broadcast to all of the lighting apparatuses 41 to N attached to the bridge device 40. Upon receipt of the JOIN Reset packet, each lighting apparatus may clear previously stored address information prior to the bridge assigning an address to each lighting apparatus.

Upon receiving the JOIN Reset packet, each lighting apparatus may parse the received JOIN Reset packet and remove an address stored in its memory. Moreover, as described with reference to FIG. 7, the controller 710 of each of the lighting apparatuses receiving the JOIN Reset packet may control the connection control circuit 735 to disconnect the data path between the input port 740 and the output port 750 of the lighting apparatus 41 to N such that a data connection to a subsequent lighting apparatus is severed. The connection control circuit 735 may disconnect the data path by short circuiting the data lines at the output port 750.

Once the preparation for address assignment has been completed by deleting the address information and disconnecting the data connection to a subsequent lighting apparatus, a new address may be assigned in the lighting apparatus. The bridge device 40 may transmit a JOIN Start packet having a command code '0xC1' to the lighting apparatus 41 which is the first connected in series. Here, because the data connections to subsequent lighting apparatuses have been disconnected in all lighting apparatuses, only the first lighting apparatus 41 connected to the bridge device 40 receives the JOIN Start packet. The JOIN Start packet may indicate the beginning of the address assignment process for the first lighting apparatus 41 in the bridge device 40. In other words, the bridge device 40 may initiate the address assignment process by transmitting the JOIN Start packet, and the lighting apparatus 41 may initialize the first connection module 451 for address assignment in response to the JOIN Start packet.

The first lighting apparatus 41 may parse the JOIN Start packet. Based on the parsed packet, the lighting apparatus 41 may transmit a JOIN Request packet to the bridge device 40. The JOIN Request packet may serve as an address assignment request packet to the bridge device 40. The JOIN Request packet may include a command code '0xC2'.

The bridge device 40, having received the JOIN Request packet, may register the lighting apparatus 41 and transmits a JOIN Response packet that includes an address. The JOIN Response packet may include a command code '0xC3'. The bridge device 40 may also transmit information related to the registered lighting apparatus 41 and corresponding address data to the lighting controller 20 through the gateway 30 for subsequent control of the lighting apparatus 41.

In one embodiment, the address data may be generated at the controller 20. For example, if the bridge device 40 receives the JOIN Request packet from the lighting apparatus 41, the bridge device 40 may register the corresponding lighting apparatus 41, transmit information regarding the registered lighting apparatus 41 to the lighting controller 20 through the gateway 30, receive address data for the lighting apparatus 41 from the lighting controller 20, include the received address data in a JOIN Response packet, and transmit the resultant JOIN Response packet to the corresponding lighting apparatus 41.

In this way, in response to the JOIN Response packet that includes the address information from the bridge device 40 (or the lighting controller 20), the lighting apparatus 41 may receive and set a new address. The controller 710 then generates a 'JOIN OK' packet for transmission to the bridge device 40 indicating completion of the address assignment process. The JOIN OK packet may include a command code '0xC4'. The JOIN OK packet may also include an identifier indicating the corresponding lighting apparatus. The identifier corresponding to the lighting apparatus 41 may be a device identifier.

Moreover, when the JOIN OK packet is transmitted, the controller 710 of the lighting apparatus 41 may control the connection control circuit 735 to reestablish the data connection to the subsequent lighting apparatus (e.g., lighting apparatus 42). The connection control circuit 735 may be controlled to be in an electrically opened state, such that the short circuit between the data lines at the output port 750 is removed.

Thereafter, a second JOIN Start packet may be transmitted by the bridge device 40. The second JOIN Start packet may pass through the first lighting apparatus 41 without address assignment to the second lighting apparatus 42 to initiate the address assignment process. The addresses in each of the lighting apparatuses may be assigned in the same manner as described above with reference to lighting apparatus 41.

The command code may also be used for operational commands and responses. For example, the data packet from the bridge device 40 to the lighting apparatus 41 may be a Control Request packet having a command code '0x03'. This data packet may control the lighting apparatus 41 to turn on or off. The data packet may be a Dimming Request packet having a command code '0x05' for controlling a brightness of the LEDs.

The data packet may be a Status Request packet having a command code '0x04' for requesting a status from a lighting apparatus. The Status Request packet may request an illumination value from the lighting apparatus. The lighting apparatus may respond with a Status Response packet having a command code '0x10', that includes a value corresponding to the illumination level of the LEDs.

A Recover Saved packet may include command code '0x12' and a value 0x00 or 0xFF. If the value in the Recover Saved packet transmitted to a lighting apparatus is 0xFF, the lighting apparatus may recover a previously stored dimming value and turn the lighting apparatus on using this value. If the value is 0x00, the lighting apparatus is turned off.

A Set Dimming Speed packet may include a command code '0x20' and values. An Alive Check Request packet and an Alive Check Response packet may include a command code '0xFD'. The Alive Check Response packet may respond with a status of the lighting apparatus to the bridge 41. A Version Request and Version Response packets may include a command code '0x30' and may be used to obtain version information for a particular lighting apparatus.

Figure 11:
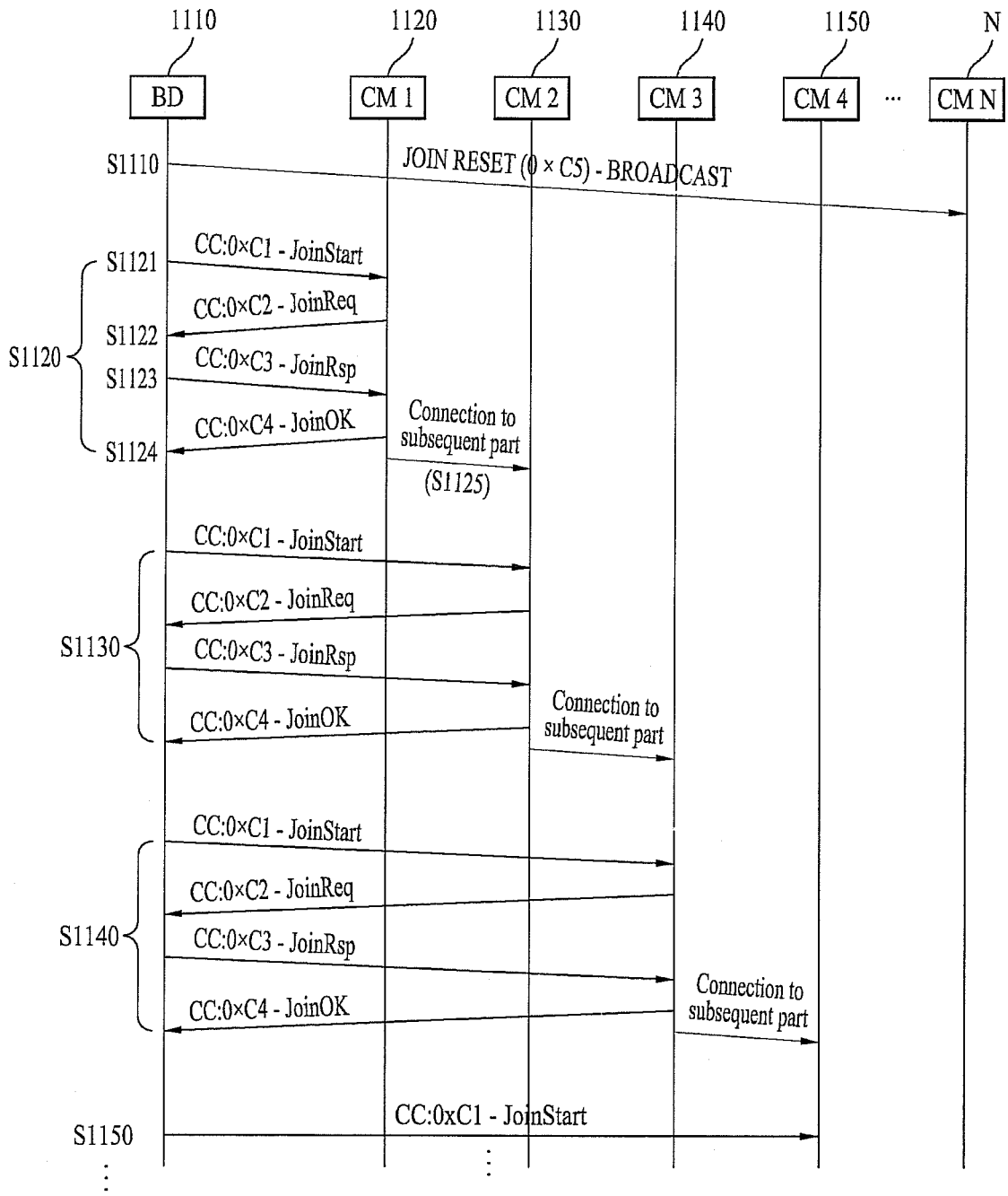
FIG. 11 is a flowchart illustrating a process for address assignment according to one embodiment of the present disclosure.

FIG. 11 is a flowchart illustrating a process for address assignment in a lighting apparatus according to one embodiment of the present disclosure. The JOIN Reset packet may be broadcast from the bridge device 1110 to all serially connected lighting apparatuses 1120 to N, in step S1110. The process for assigning an address to the first serially connected lighting apparatus may be initiated, in step S1120.

In step S1121, a JOIN Start packet may be transmitted from the bridge device 1110 to the first connection module (CM 1) 1120 of the first lighting apparatus. The connection module 1120 may respond with a JOIN Request packet, in step S1122. The bridge device 1110 registers the first lighting apparatus based on the JOIN Request packet. The bridge device 1110 may transmit a JOIN Response packet that includes a new address to the first connection module 1120, in step S1123. The first connection module 1120 parses the JOIN Response packet for the address and the new address is assigned and stored in the first connection module 1120. The first connection module 1120 transmits a JOIN OK packet to the bridge, in step S1124, once the address has been successfully assigned. The first connection module 1120 then reopens the data connection to the second connection module (CM 2) of the next serially connected lighting apparatus, in step S1125.

A process to assign an address to the second lighting apparatus may be performed, in step S1130. The bridge device 1110 may transmit a second JOIN Start packet. The second JOIN Start packet is transmitted through the first connection module 1120 to the second connection module (CM 2) 1130. For example, the JOIN Start packet for assigning an address of the second connection module 1130 is not transmitted directly from the bridge device 1110 to the second connection module 1130, but is transmitted to the second connection module 1130 through the first connection module 1120 of the first lighting apparatus.

The process in step S1130 is completed in the same manner as described with reference to step S1120 for the first lighting apparatus. For example, a JOIN request, JOIN response, and JOIN OK packets are exchanged between the bridge device 1110 and the second connection module 1130 through the first connection module 1120, and the connection to a subsequent lighting apparatus is reestablished.

During the address assignment process for the second connection module 1130, the first connection module 1120 may analyze each data packet to determine the intended destination of the packet. For example, the first connection module 1120 may compare the address in the JOIN response packet with the address stored in its memory 715. If the addresses in the data packets are different than the stored address, the first connection module 1120 may relay the packets to an adjacent device without processing the packets for address assignment. Here, if the data lines are disconnected, the first connection module 1120 may reconnect the data connection to the subsequent lighting apparatus. The process of step S1130 may be applied in steps S1140 to S1150, to assign an address to the remaining lighting apparatuses 1140 to N.

Figure 12:
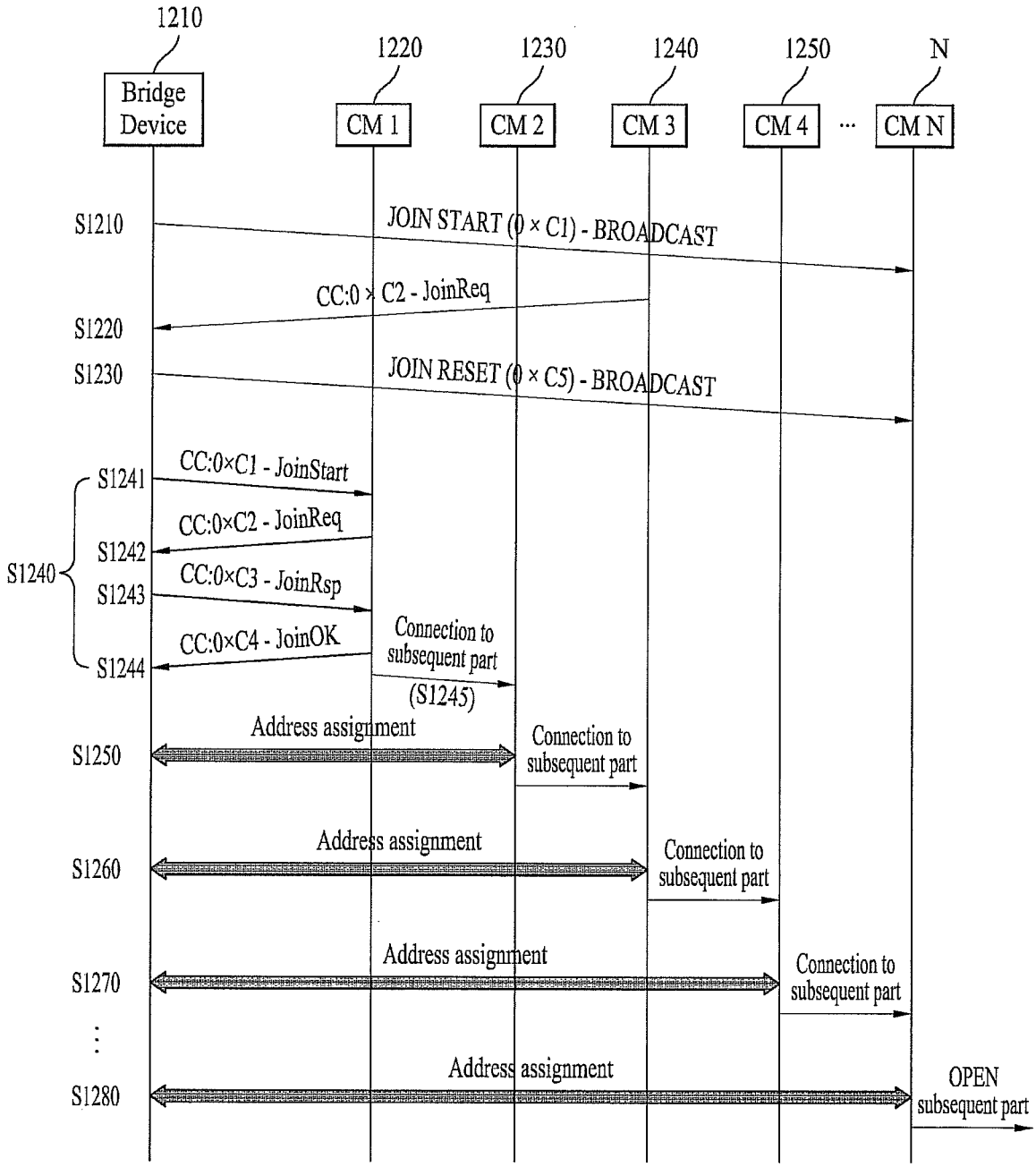
FIG. 12 is a flowchart illustrating a process for address assignment according to one embodiment of the present disclosure.

FIG. 12 is a flowchart illustrating a process for address assignment in a lighting apparatus according to one embodiment of the present disclosure. The address assignment process of this embodiment may detect a lighting apparatus that has been replaced after completion of address assignment for all the lighting apparatuses, and assign a new address to the lighting apparatuses. This process may also detect a lighting apparatus which is replaced before completion of the address assignment process for all of the lighting apparatuses.

In this embodiment, the JOIN Start packet may be continuously and periodically broadcast to all of the serially connected lighting apparatuses. For example, after addresses have been assigned to all of the lighting apparatuses, the JOIN Start packet may be used to detect any lighting apparatus which may have been replaced.

For example, the lighting apparatus corresponding to connection module 1240 may be replaced, requiring a new address. The process as illustrated in FIG. 12 may detect this replaced lighting apparatus. The JOIN Start packet may be broadcast, in step S1210. Upon receiving the JOIN Start packet, transmitted in step S1210, the connection manager 1240 of the replaced lighting apparatus may transmit a JOIN Request packet, in step S1220. The bridge device 1210 may identify the connection manager 1240 that transmitted the JOIN Request packet as corresponding to the lighting apparatus replaced after completion of a previous address allocation process.

If the bridge device 1210 receives the JOIN request packet from the third connection module 1240 in response to the JOIN Start packet transmitted in step S1210, the bridge device 1210 may initiate an address assignment process to assign a new address for all lighting apparatuses. For example, the bridge device 1210 may transmit a JOIN Reset packet to all of the connected lighting apparatuses, in step S1230. Each of the lighting apparatuses may initialize their respective address data and severs the data connection to a subsequent connection module in response to the JOIN Reset packet.

The bridge device 1210 may perform an address assignment process to assign an address to the first lighting apparatus connected in series, in step S1240. The bridge device 1210 may issue a JOIN Start packet to connection module 1220, in step S1241. The first lighting apparatus may transmit a JOIN Request packet to the bridge device 1210, in step S1242. The bridge device 1210 may respond with a JOIN Response packet, in step S1243. The first connection module 1220 may assign the received address to the first lighting apparatus and may send a JOIN OK packet as a confirmation to the bridge device 1210, in step S1244. The first connection module 1220 may reopen the data connection to the next connection module 1230, in step S1245. Thereafter, the remaining serially connected lighting apparatuses 1230 to N may be reassigned addresses in sequence, in steps S1250, S1260, S1270, and S1280, respectively, in a similar manner. Steps S1203 to S1280 of this embodiment is the same as steps S1110 to S1150, previously described with reference to FIG. 11.

Figure 13:
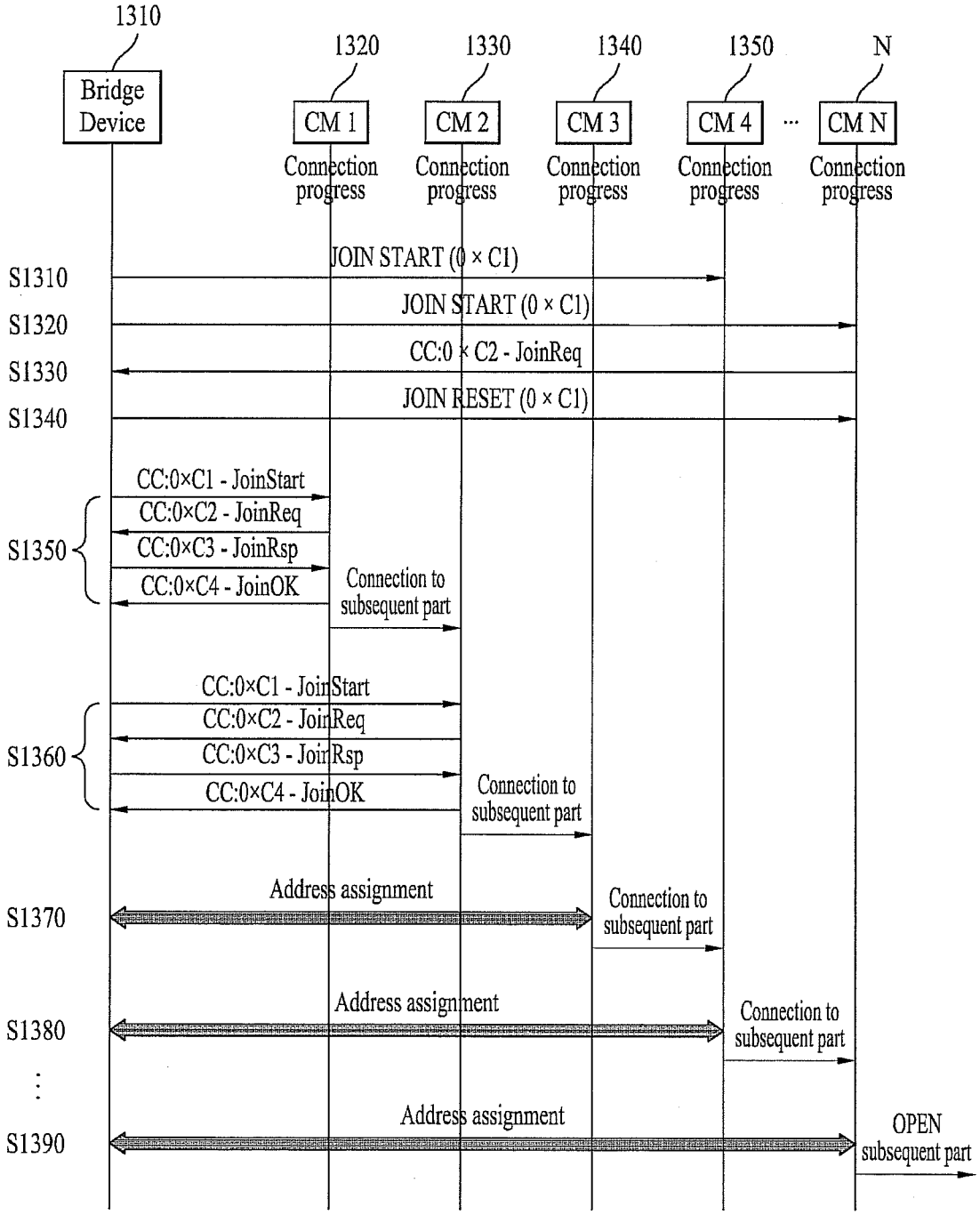
FIG. 13 is a flowchart illustrating a process for address assignment according to one embodiment of the present disclosure.

FIG. 13 is a flowchart illustrating a process for address assignment in a lighting apparatus according to one embodiment the present disclosure, in which an address is assigned to a lighting apparatus that is newly added after completion of an address assignment for all of the lighting apparatuses. In contrast to the embodiment of FIG. 12 in which a lighting apparatus that is replaced is detected, in this embodiment a newly added lighting apparatus may be detected. For example, an address assignment process is initiated after detection of a newly added N-th connection module (CM N) N. Here, the addition of connection module N is detected after address assignment has been completed up to the fourth connection module (CM4) 1350.

The bridge device 1310 may periodically transmit a JOIN Start packet upon completion of address assignment in order to detect a presence or absence of a newly added lighting apparatus, in step S1310. The bridge device 1310 may transmit the JOIN start packet to all previously connected devices, e.g., up to connection module 1350. If a fifth connection module N is added after the execution of step S1310, the connection module N may receive the next or subsequent periodic JOIN Start packet, in step S1320.

In response to receiving the JOIN Start packet, the connection module 1360 may transmit a JOIN request packet to the bridge 1310, in step S1330. The bridge device 1310 may determine that the connection manager 1360 has been newly added based on the received the JOIN Request packet. The bridge device 1310, having recognized that connection module N corresponds to a newly added lighting apparatus, transmits a JOIN reset packet to all connected lighting apparatuses, in step S1340.

The address for each lighting apparatus 1320 to N may be assigned in sequence, in steps S1350 to S1390. Steps S1350 to S1390 are the same as steps S1120 to S1150 and S1240 to S1280, previously described with reference to FIGS. 11 and 12, respectively.

In certain embodiments, the address for the newly added or replaced lighting apparatus may be assigned without broadcasting the JOIN Reset packet. For example, in step S1220 of FIG. 12, the connection manager 1240 may reset the stored address and disconnect the data connection to a subsequent lighting apparatus. Thereafter, a JOIN Response packet may be transmitted from the bridge 1210 to connection manager 1240. For example, because the JOIN Reset packet is not transmitted, connection managers 1220 and 1230 are not controlled to disconnect the data connection to a subsequent device. Hence, the JOIN Response packet may be transmitted to the third connection manager 1240.

Upon receipt of the JOIN Response packet, the connection manager 1240 may process the packet to assign and store the received address, and transmit a JOIN OK packet to the bridge device 1210. The newly added connection manager 1240 may then establish a data connection to the subsequent connection manager (e.g., 1250). In this embodiment, the bridge device 1210 may assign the address previously assigned to the lighting apparatus to the replaced lighting apparatus. The bridge device 1210 may then continue to periodically transmit a JOIN Start packet to detect replaced lighting apparatuses. A similar process may be applied to the embodiment of FIG. 13 to detect and assign an address new lighting apparatuses, without reassigning an address to all connected lighting apparatuses.

Through the above-mentioned steps, one bridge device and all lighting apparatuses connected thereto may perform real-time automatic address assignment even when an additional lighting apparatus is replaced or added. The addresses may be newly assigned without the need for additional requests from a user.

Figure 14:
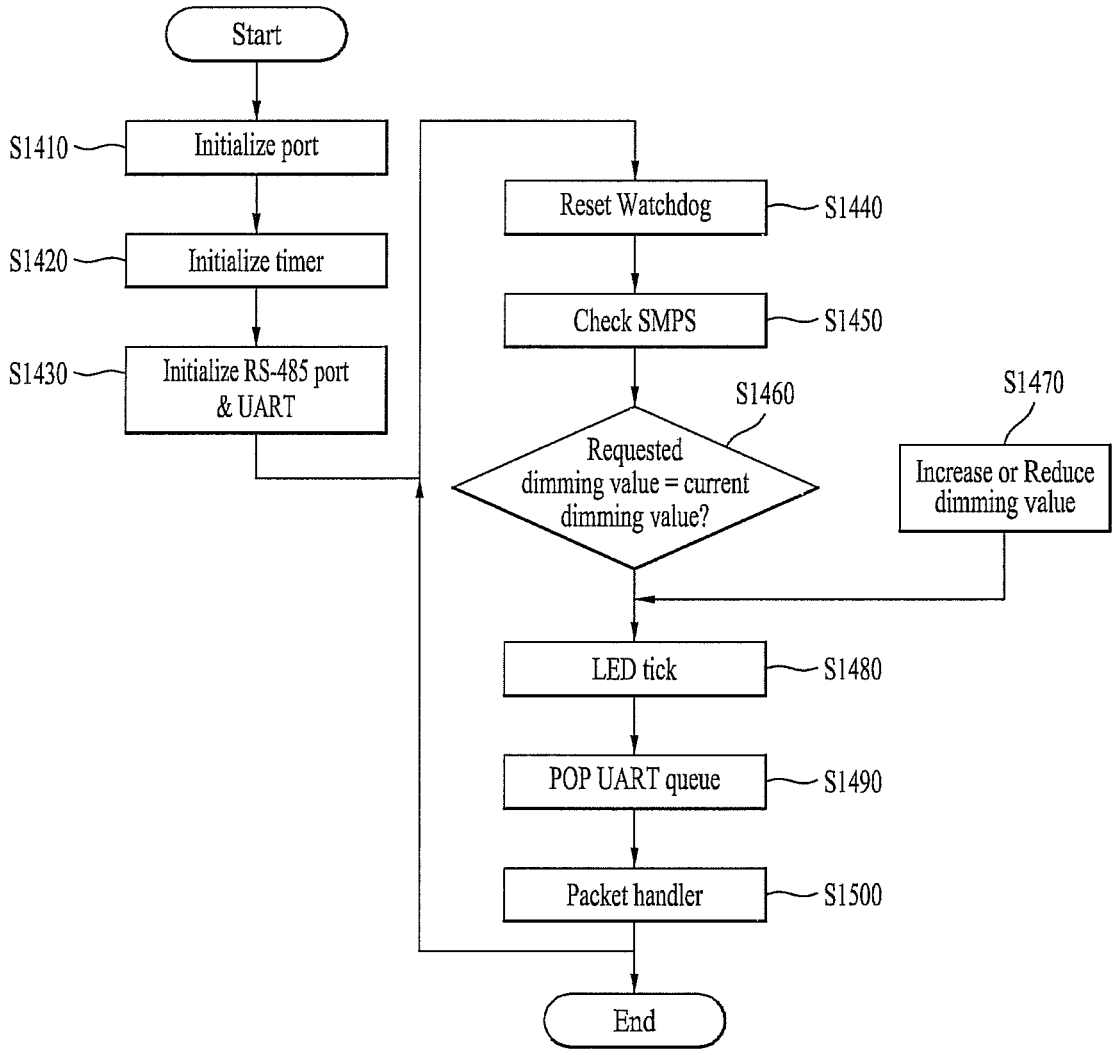
FIG. 14 is a flowchart illustrating a method for controlling a lighting system according to one embodiment of the present disclosure.

FIG. 14 is a flowchart illustrating a method for controlling a lighting system according to an embodiment of the present disclosure. A lighting apparatus 41 to N may initialize each port to perform a control operation, in step S1410. If each port is initialized, the lighting apparatus 41 to N may initialize a timer, in step S1420. The timer initialization may be synchronized with the bridge device 40 to receive each packet frame.

The lighting apparatus 41 to N may initialize the UART and the RS-485 port, in step S1430. The RS-485 port may designate an output port in the connection module 451 to N" of each lighting apparatus 41 to N for communication with the bridge device 40. A watchdog is reset, in step S1440, and a switching-mode power supply (SMPS) is checked, in step S1450. For example, the SMPS may indicate whether the bridge device 40 or each lighting apparatus 41 to N is powered on.

Upon receiving a dimming value from the bridge device 40, each lighting apparatus 41 to N may parse the corresponding dimming value, and determine whether the parsed dimming value is identical to the current dimming value, in step S1460. If the current dimming value is determined to be different from the requested dimming value, in step S1460, the current dimming value is changed based on the requested dimming value, in step S1470. A tick operation for the light emitting module may be performed in response to the new dimming value, in step S1480, to change the light output. If necessary, each lighting apparatus 41 to N may pop the UART queue, in step S1490. The packet handler may request specific information dependent upon the popped-up UART queue, in step S1500.

As apparent from the above description, in the lighting system as broadly described and embodied herein, a unique address may be automatically assigned to each lighting apparatus for use in the lighting system. The lighting apparatuses having the unique addresses may be controlled together as a group or independently. Moreover, a simple circuit configuration may be achieved according to the disclosed connection schemes of the lighting apparatuses for automatically assigning a unique address to each lighting apparatus.

As broadly disclosed and embodied herein, a lighting system may include a first lighting apparatus, a second lighting apparatus connected to the first lighting apparatus in series, and a bridge device coupled to the first and second lighting apparatuses in series and configured to assign an address to the first and second lighting apparatuses. The first lighting apparatus may include a first LED module, and a first control circuit that controls a first connection to the second lighting apparatus. The second lighting apparatus may include a second LED module, and a second control circuit that controls a second connection to a subsequent lighting apparatus connected in series. The bridge device may transmit a first data packet to initialize the first and second lighting apparatuses for address assignment and, in response to the first data packet, the first and second control circuits disconnects the first and second connections and the bridge device may transmit a second data packet that includes a first address to the first lighting apparatus. The first control circuit may determine whether an address assignment is needed in the first lighting apparatus, assign the first address to the first lighting apparatus based on the determination, and connect the first connection to the second lighting apparatus.

The first lighting apparatus may determine whether an address assignment is needed based on whether a previously assigned address exists. If the first control circuit determines that the previously assigned address does not exist, the first control circuit assigns the first address to the first lighting apparatus. The first control circuit may transmit a confirmation to the bridge device if the first address is successfully assigned to the first lighting apparatus. The bridge device may transmit a third data packet that includes a second address to the second lighting apparatus through the first lighting apparatus in response to the confirmation. The second control circuit may determine whether a previously assigned address exists for the second control circuit, and if the previously assigned address does not exist, the second controller assigns the second address to the second lighting apparatus, and if the previously assigned address exists, the second controller connects the second connection to the subsequent lighting apparatus and forwards the second address through the second connection. Moreover, if the first control circuit determines that the previously assigned address exists, the first control circuit may forward the first address to the second lighting apparatus through the first connection.

In response to the first data packet, the first and second control circuits may delete previously assigned addresses in the first and second control circuits. The bridge device may periodically send a query to the serially connected lighting apparatuses to detect a lighting apparatus that requires address assignment. The lighting apparatus that requires address assignment may transmit a request for address assignment to the bridge device through the serial connection. The bridge device may transmit the first data packet in response to the request for address assignment. The bridge device may sequentially assign an address to all serially connected lighting apparatuses in response to the request for address assignment from at least one of the lighting apparatuses. Moreover, the lighting apparatus that requires address assignment may be at least one of the first or second lighting apparatuses and/or the lighting apparatus that requires address assignment may be a newly added or replaced lighting apparatus.

The bridge device may be connected in series to the first and second lighting apparatuses according to a RS-485 communication protocol. The bridge device may be configured based on a ZigBee standard.

As broadly described and embodied herein, a lighting system may include a plurality of lighting apparatuses connected in series, at least one bridge device coupled to the plurality of lighting apparatuses in series, and a central lighting controller coupled to the at least one bridge device for controlling the lighting apparatuses, wherein the bridge device is configured to initialize the plurality of lighting apparatuses for address assignment such that a connection to a subsequent lighting apparatus is disconnected, the bridge device sequentially assigns an address to each lighting apparatus, and the central lighting controller controls the plurality of lighting apparatuses based on the assigned addresses.

The lighting apparatuses may include a control circuit having an input port, an output port, and a switch provided to connect or disconnect a data line between the input and output ports, wherein the control circuit controls the switch to disconnect the data line to initialize the lighting apparatus for address assignment and reconnect the if an address is assigned.

As broadly described and embodied herein, a method for controlling a plurality of lighting apparatuses may include transmitting a periodic signal to the plurality of lighting apparatuses to detect a lighting apparatus that requires address assignment, the lighting apparatuses connected in series, receiving a request for address assignment from one of the plurality of lighting apparatuses, initializing the plurality of lighting apparatuses for address assignment based on the request, sequentially assigning an address to the plurality of lighting apparatuses, and controlling the plurality of lighting apparatuses based on the assigned addresses. The initializing may include disconnecting a data connection between each of the plurality of lighting apparatuses and a subsequent lighting apparatus, and the sequentially assigning may include reconnecting the data connection after the address is assigned.

As broadly described and embodied herein, a method for controlling a lighting apparatus in lighting system may include transmitting a first packet for initializing to a plurality of lighting apparatuses, wherein each lighting apparatus releases a connection with a subsequent lighting apparatus, and transmitting a second packet including address data to the lighting apparatus, wherein the lighting apparatus decodes and stores the address data from the second packet and then connects with a subsequent lighting apparatus.

The method may further include transmitting a third packet including address data to the lighting apparatus. Each packet may include a packet identifier for identifying a type of corresponding packet. The lighting apparatus may determine whether address data is previously stored. The lighting apparatus controls a transfer of the address data to a subsequently connected lighting apparatus if the address data is previously stored.

The method may further include receiving a packet to request an address from each lighting apparatus. The method may further include determining the packet including a request for assigning an address from the lighting apparatus in order to transmit the first packet. The method may further include receiving a packet including a response indicating address assignment completion from the corresponding light emitting part. Moreover, the method may further include transmitting a fourth packet including control data to the lighting apparatus being assigned address.

In one embodiment, a method for controlling a plurality of lighting apparatuses for use in a lighting system may include initializing each lighting apparatus, sequentially assigning an address to the individual lighting apparatus, and controlling the lighting apparatus being assigned the address, wherein the step of initializing includes releasing a connection with a subsequent lighting apparatus. The releasing a connection with the subsequent lighting apparatus may be performed by electrically connecting a plurality of ports in order to transfer data to a subsequent lighting apparatus.

In one embodiment, a method for controlling a plurality of light emitting parts for use in a light control apparatus may include a) receiving a request from any one of the plurality of lighting apparatuses, b) transmitting a first packet for initializing all lighting apparatuses, c) transmitting a second packet for assigning an address of the plurality of lighting apparatus, and d) controlling the lighting apparatus on the basis of the assigned address of corresponding lighting apparatus. The step (a) may be performed if a lighting apparatus is inserted into the plurality of light emitting parts or is added thereto.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting system comprising:

a plurality of lighting apparatuses;

a bridge device coupled to the plurality of lighting apparatuses in series and configured to assign an address to the plurality of lighting apparatuses, wherein each of the plurality of lighting apparatuses includes a LED module, an input port to receive data from the bridge device, an output port to relay the address data to another lighting apparatus, a connection circuit configured to electrically connect or disconnect a connection between the input port and the output port based on a connection between the at least one bridge device and the plurality of light apparatuses, and a control circuit that controls the connection circuit based on the address, and wherein the bridge device transmits a first data packet to initialize the plurality of lighting apparatuses for address assignment and, in response to the first data packet, the control circuit of each of the plurality of lighting apparatuses disconnects the connection with a subsequent lighting apparatus, and the bridge device transmits a second data packet that includes a first address to a first lighting apparatus among the plurality of lighting apparatuses, wherein a first control circuit included in the first lighting apparatus determines whether an address assignment is needed in the first lighting apparatus, assigns the first address to the first lighting apparatus based on the determination, and connects the first connection to a second lighting apparatus among the plurality of lighting apparatuses.

2. The lighting system of claim 1, wherein each of the plurality of the lighting apparatus determines whether an address assignment is needed based on whether a previously assigned address exists.

3. The lighting system of claim 2, wherein, if the first control circuit determines that the previously assigned address does not exist, the first control circuit assigns the first address to the first lighting apparatus.

4. The lighting system of claim 3, wherein the first control circuit transmits a confirmation to the bridge device if the first address is successfully assigned to the first lighting apparatus.

5. The lighting system of claim 4, wherein the bridge device transmits a third data packet that includes a second address to the second lighting apparatus through the first lighting apparatus in response to the confirmation.

6. The lighting system of claim 5, wherein the second control circuit determines whether a previously assigned address exists for the second control circuit, and if the previously assigned address does not exist, the second controller assigns the second address to the second lighting apparatus, and if the previously assigned address exists, the second controller connects the second connection to the subsequent lighting apparatus and forwards the second address through the second connection.

7. The lighting system of claim 2, wherein, if the first control circuit determines that the previously assigned address exists, the first control circuit forwards the first address to the second lighting apparatus through the first connection.

8. The lighting system of claim 1, wherein, in response to the first data packet, the first and second control circuits deletes previously assigned addresses in the first and second control circuits.

9. The lighting system of claim 1, wherein the bridge device periodically sends a query to the serially connected lighting apparatuses to detect a lighting apparatus that requires address assignment.

10. The lighting system of claim 9, wherein the lighting apparatus that requires address assignment transmits a request for address assignment to the bridge device through the serial connection.

11. The lighting system of claim 10, wherein the bridge device transmits the first data packet in response to the request for address assignment.

12. The lighting system of claim 11, wherein the bridge device sequentially assigns an address to all serially connected lighting apparatuses in response to the request for address assignment from at least one of the lighting apparatuses.

13. The lighting system of claim 10, wherein the lighting apparatus that requires address assignment is at least one of the first or second lighting apparatuses.

14. The lighting system of claim 10, wherein the lighting apparatus that requires address assignment is a newly added or replaced lighting apparatus.

15. The lighting system of claim 1, wherein the bridge device is connected in series to the first and second lighting apparatuses according to a RS-485 communication protocol.

16. The lighting system of claim 1, wherein the bridge device is configured based on a ZigBee standard.

17. A method for controlling a plurality of lighting apparatuses, wherein each of the plurality of lighting apparatuses includes a LED module, an input port to receive data from the bridge device, an output port to relay the address data to another lighting apparatus, a connection circuit configured to electrically connect or disconnect a connection between the input port and the output port based on a connection between the at least one bridge device and the plurality of light apparatuses, and a control circuit that controls the connection circuit based on the address, the method comprising:

receiving a periodic signal from a bridge device to detect a lighting apparatus that requires address assignment, the plurality of lighting apparatuses connected in series;

transmitting a request for address assignment to the bridge device;

receiving a first data packet to initialize the plurality of lighting apparatuses for address assignment;

initializing the plurality of lighting apparatuses for address assignment in response to the first data packet, wherein a control circuit of each of the plurality of lighting apparatuses disconnects a connection with subsequent lighting apparatuses, and;

receiving a second data packet that includes a first address to a first lighting apparatus among the plurality of lighting apparatuses;

sequentially assigning an address to the plurality of lighting apparatuses; and controlling the plurality of lighting apparatuses based on the assigned addresses, wherein the method further comprises determining whether an address assignment is needed in the first lighting apparatus, assigning the first address to the first lighting apparatus based on the determination, and connecting the first connection to a second lighting apparatus among the plurality of lighting apparatuses.

18. The method according to claim 17, wherein the initializing includes disconnecting a data connection between each of the plurality of lighting apparatuses and a subsequent lighting apparatus, and the sequentially assigning includes reconnecting the data connection after the address is assigned.

* * * * *